US010390626B2

(12) United States Patent
Oh

(10) Patent No.: US 10,390,626 B2
(45) Date of Patent: Aug. 27, 2019

(54) ASSEMBLABLE MATTRESS SUPPORT WHOSE COMPONENTS FIT INSIDE THE HEADBOARD

(71) Applicant: Zinus Inc., San Leandro, CA (US)

(72) Inventor: Suk Kan Oh, Xiamen (CN)

(73) Assignee: Zinus Inc., Tracy, CA (US)

( * ) Notice: Subject to any disclaimer, the term of this patent is extended or adjusted under 35 U.S.C. 154(b) by 477 days.

(21) Appl. No.: 15/263,374

(22) Filed: Sep. 13, 2016

(65) Prior Publication Data

US 2016/0374478 A1 Dec. 29, 2016

Related U.S. Application Data

(63) Continuation of application No. 14/570,124, filed on Dec. 15, 2014, now Pat. No. 9,474,382, which is a (Continued)

(51) Int. Cl.
*A47C 19/00* (2006.01)
*A47C 23/06* (2006.01)
(Continued)

(52) U.S. Cl.
CPC ..... *A47C 19/005* (2013.01); *A47C 19/022* (2013.01); *A47C 19/025* (2013.01); *A47C 23/06* (2013.01); *B65D 85/70* (2013.01)

(58) Field of Classification Search
CPC ..... A47C 19/00; A47C 19/022
(Continued)

(56) References Cited

U.S. PATENT DOCUMENTS 19,449 A 2/1858 Robbins ..... 5/498
1,236,515 A 8/1917 Welch ..... 5/135
(Continued)

FOREIGN PATENT DOCUMENTS

CN 2497639 Y 8/2001
CN 201032946 Y 11/2006

OTHER PUBLICATIONS

Article entitled "Amazing Bed in a Box" in Home Design, Garden & Architecture Blog Magazine, downloaded from Internet on Apr. 5, 2016 from website http://www.goodshomedesign.com/amazing-bed-in-a-box (12 pages).

(Continued)

*Primary Examiner* — Fredrick C Conley
(74) *Attorney, Agent, or Firm* — Imperium Patent Works; Darien K. Wallace

(57) ABSTRACT

An assemblable mattress support can be shipped with all of its components compactly packed into the headboard. The mattress support includes a foldable longitudinal bar, a lateral bar, side panels, wooden slats, block legs and a footboard, all of which fit inside a compartment in the headboard. In an assembled state of the mattress support, a first connector at one end of the longitudinal bar attaches to a third connector on the outside of the headboard. A second connector at the other end of the longitudinal bar attaches to a fourth connector on the footboard. The middle of the lateral bar connects to the middle of the longitudinal bar. The block legs are attached to the bottom sides of the headboard and footboard. The slats are attached to one another by fabric ribbons and are placed in parallel over the longitudinal bar and support ledges on the side panels.

25 Claims, 11 Drawing Sheets

Related U.S. Application Data continuation of application No. 14/037,322, filed on Sep. 25, 2013, now Pat. No. 8,931,123.

(51) Int. Cl.
*A47C 19/02* (2006.01)
*B65D 85/00* (2006.01)

(58) Field of Classification Search
USPC ..... 5/53.1–53.3
See application file for complete search history.

(56) References Cited

U.S. PATENT DOCUMENTS

| | | | | |
|---|---|---|---|---|
| 2,147,011 | A | 2/1939 | Crawford | 105/315 |
| 2,672,624 | A | 3/1954 | Giuseffi | 5/2.1 |
| 3,046,572 | A | 7/1962 | Eames et al. | 5/136 |
| 3,116,494 | A | 1/1964 | Bennett et al. | 5/136 |
| 3,419,921 | A | 1/1969 | Flood | 5/308 |
| 3,965,498 | A * | 6/1976 | Boni | A47C 17/58 5/6 |
| 4,885,813 | A | 12/1989 | McNamara | 5/136 |
| 4,999,865 | A | 3/1991 | Sauder et al. | 5/149 |
| 5,036,556 | A | 8/1991 | Wieland | 5/53.1 |
| 5,978,988 | A | 11/1999 | Burchett | 5/136 |
| 6,105,185 | A | 8/2000 | DiRocco | 5/164.1 |
| 7,181,784 | B1 | 2/2007 | Geilear | 5/308 |
| 7,231,675 | B1 | 6/2007 | Rucinski et al. | 5/136 |
| 7,676,859 | B2 | 3/2010 | Brossier | 5/13 |
| 7,937,786 | B2 | 5/2011 | Bergkvist | 5/99.1 |
| 7,937,787 | B2 * | 5/2011 | Whitford | A47C 17/46 5/133 |
| 8,006,327 | B1 | 8/2011 | Burchett | 5/136 |
| 8,316,485 | B2 | 11/2012 | Lee et al. | 5/201 |
| 8,370,973 | B1 | 2/2013 | Oh | 5/250 |
| 8,407,834 | B1 | 4/2013 | Oh | 5/250 |
| 8,566,980 | B2 | 10/2013 | Grone | 5/136 |
| 8,707,478 | B2 | 4/2014 | Jin | 5/200.1 |
| 8,898,831 | B1 | 12/2014 | Burchett | 5/136 |
| 2004/0000009 | A1 * | 1/2004 | Choi | A47C 4/286 5/174 |
| 2006/0021135 | A1 | 2/2006 | Harvey | 5/93.2 |
| 2006/0107456 | A1 | 5/2006 | Joseph | 5/2.1 |
| 2008/0060130 | A1 | 3/2008 | Caillaud | 5/136 |
| 2009/0064415 | A1 * | 3/2009 | Payne | A47C 7/66 5/620 |
| 2009/0134648 | A1 * | 5/2009 | Maximilien | A47C 17/80 296/24.33 |
| 2010/0138994 | A1 | 6/2010 | Lee et al. | 5/400 |
| 2010/0235985 | A1 | 9/2010 | Singer | 5/3 |
| 2011/0197795 | A1 | 8/2011 | Baugh et al. | 108/50.11 |
| 2012/0079658 | A1 | 4/2012 | Christoffel | 5/503.1 |
| 2013/0067659 | A1 | 3/2013 | Oh | 5/400 |

OTHER PUBLICATIONS

"Easy and Convenient Assemblable Cloth Hanger," Apr. 8, 2013, downloaded from Taiwanese blog http://tw.becuber.com/space.php?do=blog&uid=5&id=6013 (6 pages).

Assembly Instructions for "Modus Tiffany Storage Bed (Motiff)" by Modus Furniture International, Dec. 2, 2010 (10 pages).

Assembly Instructions for "Tifanny Storage Bed Full Size (F4)" by Modus Furniture International, May 25, 2010 (2 pages).

Assembly Instructions for "Ledge Headboard Twin and Full" headboard by Modus Furniture International, May 16, 2012 (2 pages).

Assembly Instructions for "Aspelund" bed by IKEA of Sweden, 2004 (16 pages).

* cited by examiner

ASSEMBLABLE MATTRESS SUPPORT WHOSE COMPONENTS FIT INSIDE THE HEADBOARD

CROSS REFERENCE TO RELATED APPLICATION

This application is a continuation of, and claims priority under 35 U.S.C. § 120 from, U.S. patent application Ser. No. 14/570,124 entitled "An Assemblable Mattress Support Whose Components Fit Inside The Headboard," filed on Dec. 15, 2014. application Ser. No. 14/570,124, in turn, is a continuation of U.S. patent application Ser. No. 14/037,322 entitled "An Assemblable Mattress Support Whose Components Fit Inside The Headboard," filed on Sep. 25, 2013, now U.S. Pat. No. 8,931,123. The subject matter of each of the aforementioned patent documents is incorporated herein by reference.

TECHNICAL FIELD

The described embodiments relate to bedding products, and more particularly to a bed frame assembled from components that fit compactly inside the headboard of the bed frame.

BACKGROUND

Conventional beds in the United States typically include a bed frame that supports a box spring and a mattress. The bed frame can be a simple metal frame or a more substantial piece of furniture. Platform beds and other types of bedroom furniture are typically heavy and bulky and are difficult to move and assemble without professional assistance. Simple metal bed frames typically includes two side rails connected by a plurality of cross bars. The box spring typically rests on wooden slats that span between the side rails. While the cross bars may include multiple overlapping pieces, each side rail of a conventional metal frame is a single piece of metal about as long as the box spring and mattress that are to be supported in order to maintain stability. The side rails and cross bars are usually formed from elongated pieces of steel having an L-shaped cross-section (also called angle iron). A horizontal flange of each side rail supports the box spring, and a vertical flange prevents each side rail from bending under the weight of the box spring, the mattress and the occupants of the bed. Thick metal is used to provide structural integrity to the side rails, rending them heavy, long and awkward.

Moving and assembling conventional beds is cumbersome because multiple tools and many non-intuitive steps are typically involved. Another shortcoming of conventional beds is the relatively heavy weight of the wood of the furniture-type beds and of the thick steel of the metal bed frames. The heavy weight results in higher shipping costs and difficulty of assembly.

Thus, a bed is sought that overcomes the shortcomings of conventional beds, such as the long length of the side rails, the heavy weight of the wood and steel components and the complicated assembly that requires multiple tools. The bed should be compact, light weight and easily assembled.

SUMMARY

An assemblable mattress support can be shipped in a compact state with all of its components compactly packed into the headboard. The mattress support includes a foldable longitudinal bar, a lateral bar, side panels, wooden slats, block legs and a footboard, all of which fit inside a compartment in the headboard. The headboard and footboard have leather coverings. The compartment is accessible through a flap in the leather covering, which is closed by a zipper. A first connector at one end of the longitudinal bar is adapted to attach to a third connector on the headboard. A second connector at the other end of the longitudinal bar is adapted to attach to a fourth connector on the footboard. In the assembled state of the mattress support, the first connector is attached to the third connector, and the second connector is attached to the fourth connector. A bracket at the middle of the lateral bar fits into a slot at the middle of the extended longitudinal bar. Support legs are pivotally attached to the longitudinal and lateral bars. The block legs are attached to the outer bottom side of the headboard and to the bottom side of the footboard. The wooden slats are attached to one another by fabric ribbons and are extended in parallel over the longitudinal bar and support ledges on the insides of the side panels. The wooden slats are approximately as long as the lateral bar. Various embodiments of the mattress support are designed to accommodate different sized mattresses.

A method of packing the assemblable mattress support includes folding the longitudinal bar before placing the longitudinal bar inside the compartment in the headboard. The lateral bar, footboard, wooden slats, block legs and side panels are also placed in the compartment. The compartment is closed by zipping a flap in the back side of the headboard closed. The first connector on the longitudinal bar is adapted to attach to a third connector on the outside of the headboard. And the second connector on the longitudinal bar is adapted to attach to a fourth connector on the footboard. The lateral bar is adapted to attach to the longitudinal bar at the middle of the lateral bar. The packed headboard is then placed inside a packing box.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
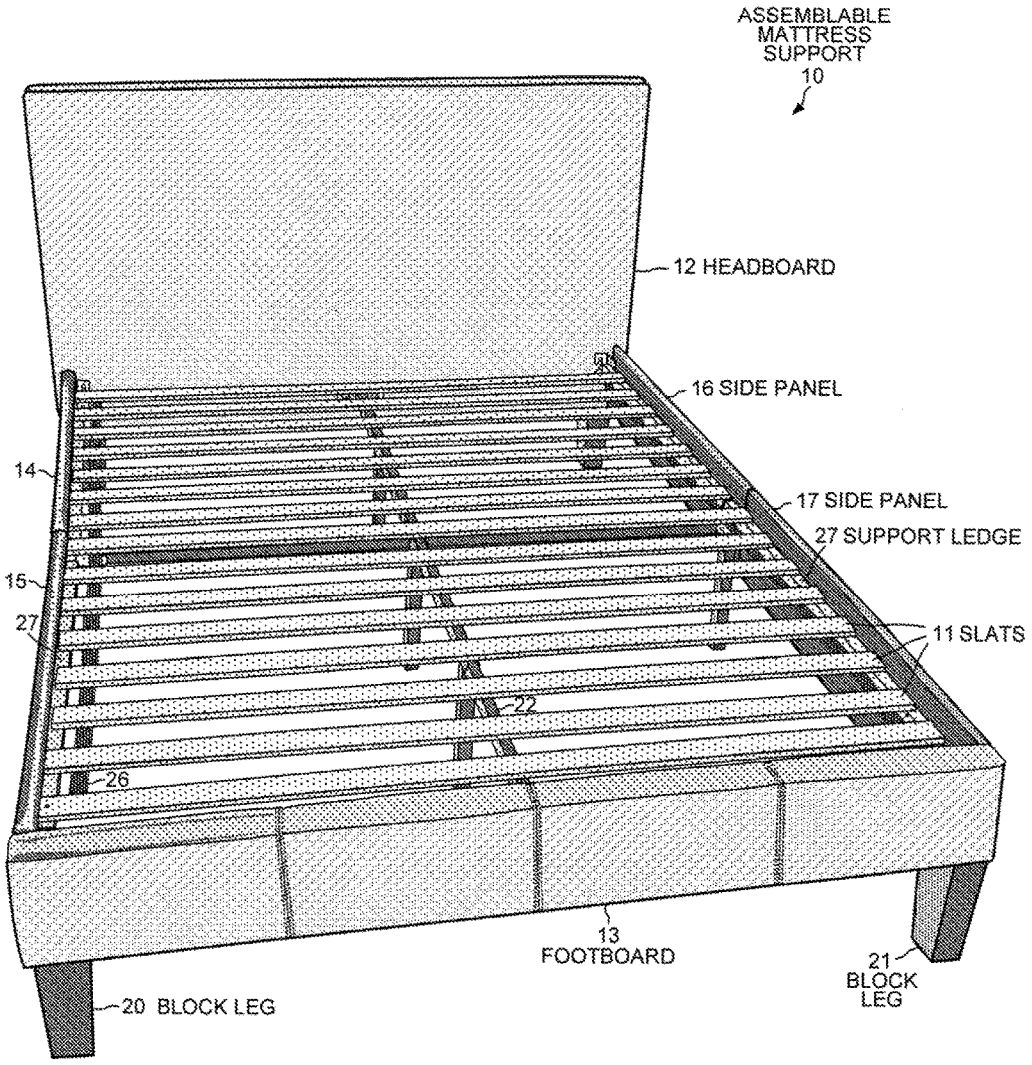
FIG. 1 is a perspective view of the assembled state of a mattress support whose components fit inside the headboard.

FIG. 1 shows a compact assemblable mattress support 10 in an assembled state. In the embodiment of FIG. 1, mattress support 10 supports a Queen size mattress. Other embodiments support full, Eastern King and California King size mattresses. No box spring is required when using mattress support 10 because the mattress can rest directly on slats 11 of the mattress support. Mattress support 10 includes a headboard 12, a footboard 13, side panels 14-17, block legs 18-21, slats 11, a longitudinal bar 22 and a lateral bar 23.

All of the remaining components of mattress support 10 can be packed inside headboard 12 in a compact state of the mattress support that is suitable both for shipping from the manufacturer to wholesalers and retailers and for transporting from the place of purchase to the location where the customer will assemble his bed. Each side of mattress support 10 is divided into two side panels 14-15 and 16-17 because the full length of the mattress support (also the length of an associated mattress) would not fit inside headboard 12. All of the components, including the block legs 18-19 that attach to the bottom side of headboard 12 fit compactly inside a compartment that opens from the back side of the headboard. Thus, the packed headboard 12 fits efficiently into a rectangular shipping box.

By enabling the user to assemble the components of mattress support 10 after the packing box has been transported to the location where the bed will be assembled, damage to stair wells, elevators and doorways can be avoided. The long and heavy side rails of a conventional metal bed frame, and even the packing box containing the rails, are difficult to maneuver without damaging stair wells, elevators and doorways. Bedroom furniture, such as a platform bed, is also difficult to move. The packing box containing the components of mattress support 10 can be more easily maneuvered up stairs, into apartment elevators and around corners. In addition, the packing box containing the components of mattress support 10 is light and compact enough to fit in a typical sports utility vehicle and, therefore, can be sold in mass-market, general merchandise retail stores (discount department stores) that do not provide furniture delivery. Thus, mattress support 10 can be sold in discount department stores without customer assistance, whereas conventional metal bed frames and bedroom furniture can be sold only at specialty stores that offer assistance (personnel or special carts) for transporting the metal frames and platform beds to the check-out counter and to the customer's vehicle. Mattress support 10 can also be sold online and delivered by a standard shipper.

Figure 2:
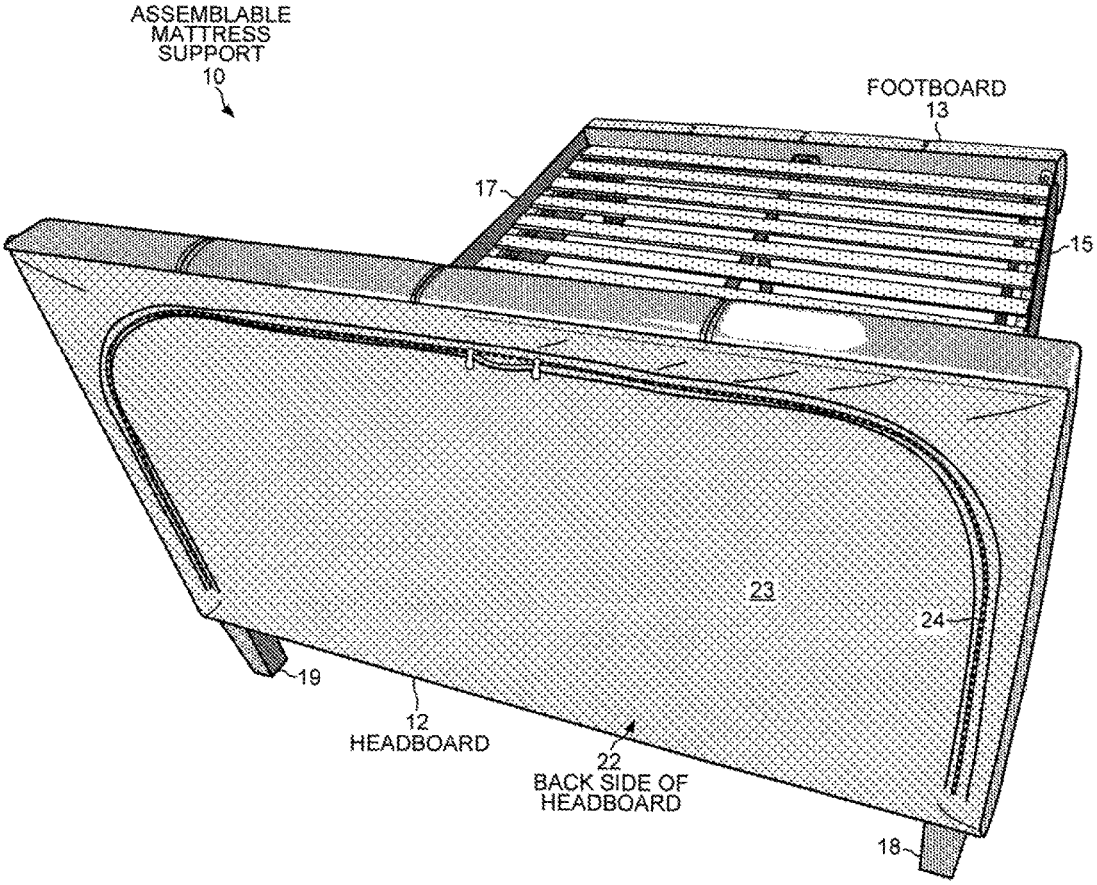
FIG. 2 is a perspective view of the mattress support of FIG. 1 viewed from the back side of the headboard.

FIG. 2 shows mattress support 10 viewed from the back side 22 of headboard 12. Headboard 12 is covered by leather, artificial leather or fabric. A flap 23 in back side 22 is closed by a zipper 24. In one embodiment, the front side of headboard 12 is made of leather, and back side 22 is made of fabric. A compartment inside headboard 12 is accessible by folding back flap 23 in back side 22. the opening for the compartment is usually not visible because the back side of the headboard 12 is typically placed against a wall.

Figure 3:
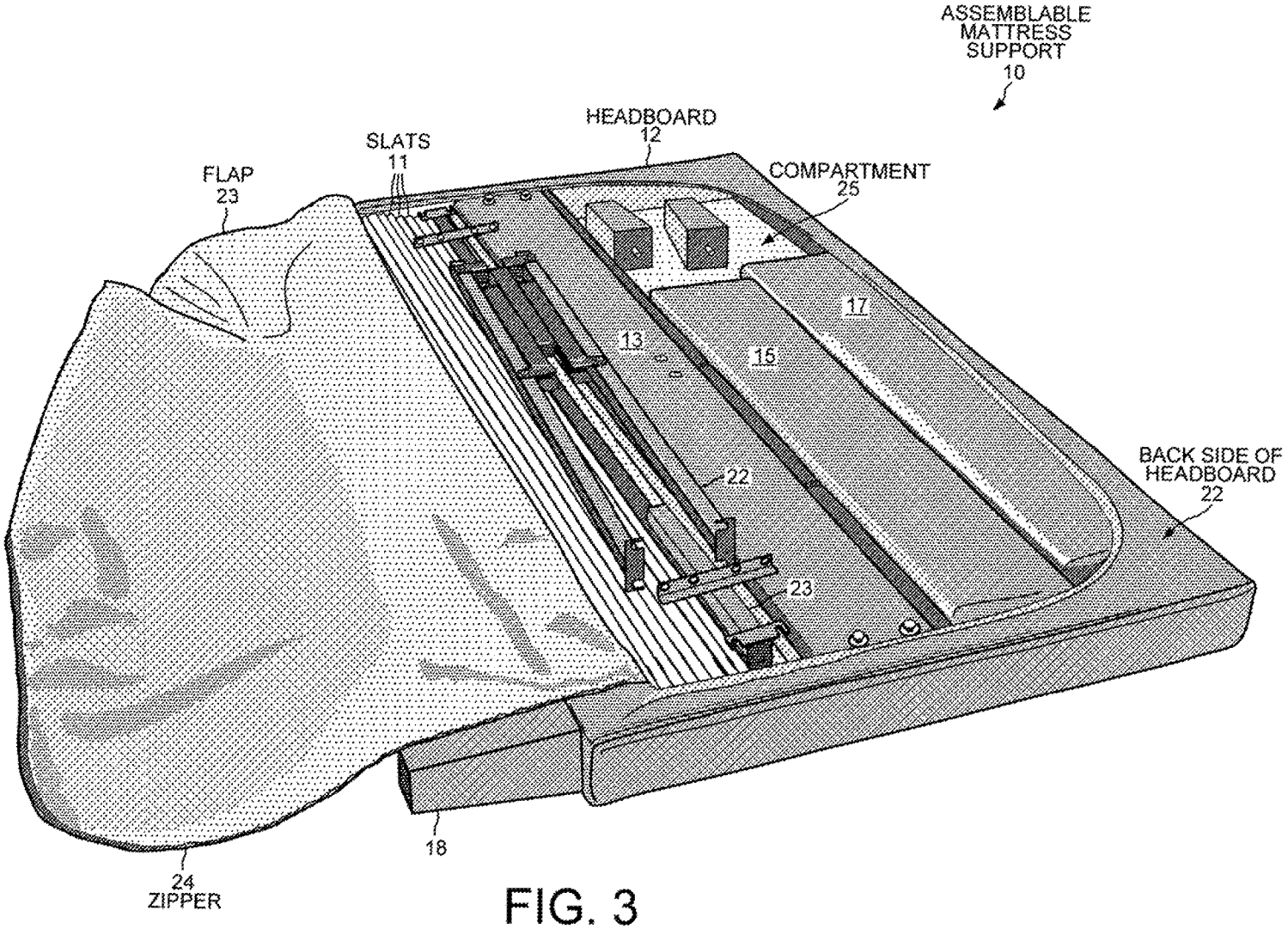
FIG. 3 shows the headboard of FIG. 1 lying flat with a flap on its back side opened.

FIG. 3 shows headboard 12 lying on the floor with flap 23 opened. A compartment 25 in headboard 12 accommodates the remaining components of mattress support 10. For example, a customer who is assembling mattress support 10 in a bedroom would find the components of the mattress support packed as illustrated in compartment 25 after opening flap 23. In FIG. 3, block legs 18-19 have already been removed from compartment 25 and have been screwed into the bottom side of headboard 12. The other two block legs 20-21 are still in compartment 25. FIG. 3 shows how footboard 13, side panels 14-17, block legs 18-21, slats 11, longitudinal bar 22 and lateral bar 23 fit into compartment 25. Note that the length of each side panel 14-17 is more than half of the length of compartment 25. Thus, a single piece side panel of mattress support 10 would not fit inside compartment 25. Longitudinal bar 22 must be folded in order to fit into compartment 25. Lateral bar 23 and slats 11 have approximately the same length, which corresponds to the width of the mattress that mattress support 10 is designed to support. The inner length of compartment 25 is at least as long as the length of slats 11 and lateral bar 23. Footboard 13 is even longer than slats 11 and lateral bar 23 and also fits inside compartment 25.

Figure 4:
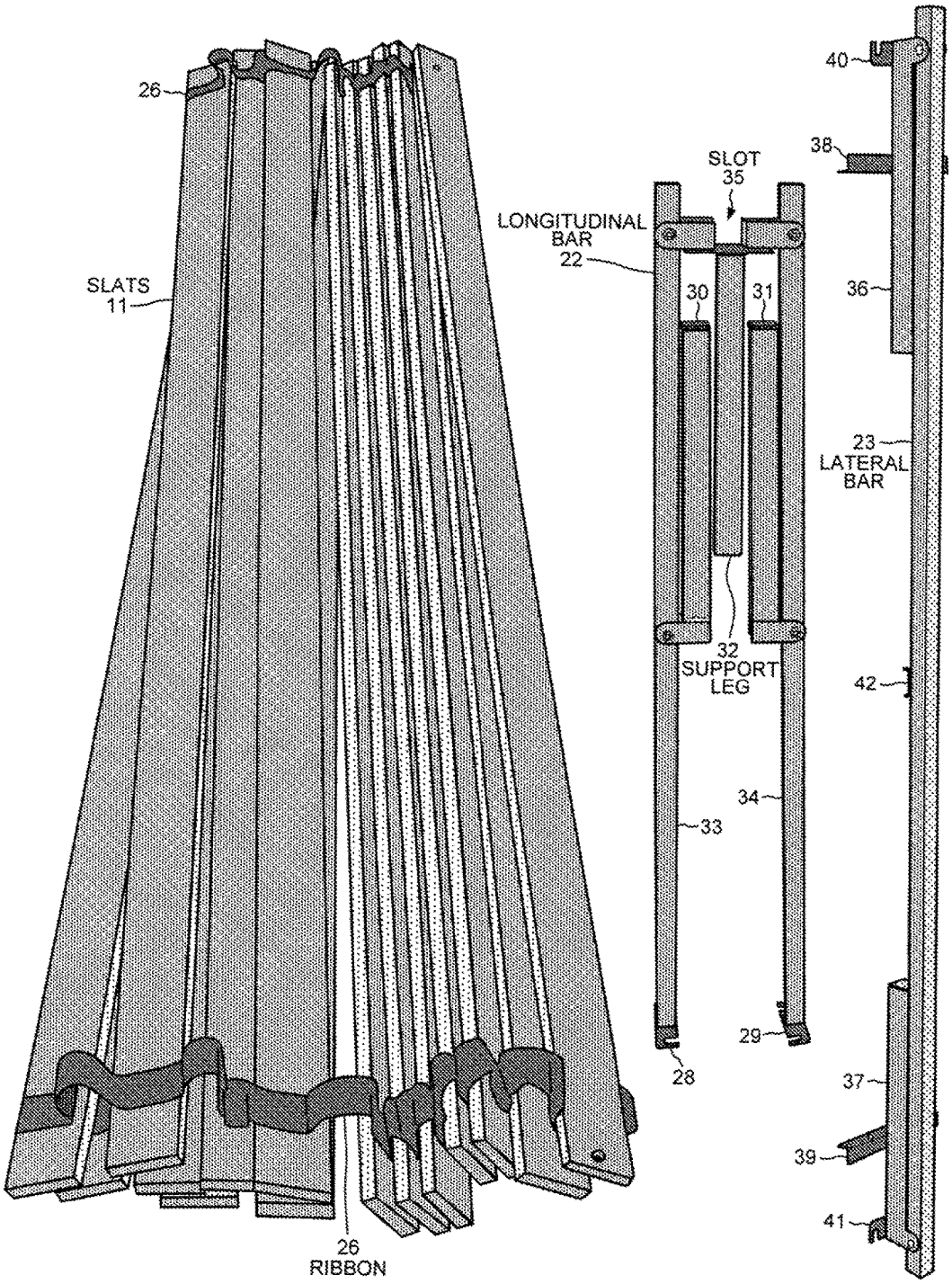
FIG. 4 shows the slats, longitudinal bar and lateral bar of the mattress support of FIG. 1 in more detail.

FIG. 4 shows slats 11, longitudinal bar 22 and lateral bar 23 in more detail. Slats 11 are wooden planks about sixty inches long and three inches wide. The fifteen wooden slats 11 are attached to each other near their ends by ribbons 26 made of strong synthetic fabric. The ribbons 26 are attached to the bottom side of each slat 11, for example by staples, so that the slats can be stacked flat against each other in compartment 25 as shown in FIG. 3 or expanded out in parallel across longitudinal bar 22 as shown in FIG. 1. The ends of wooden slats 11 rest on support ledges 27 that are attached to the insides of side panels 14-17. Wooden slats 11 are shown in FIG. 4 as flat boards. In another embodiment, however, wooden slats 11 are bowed such that they rest on support ledges 27 but bow above longitudinal bar 22. The bowed slats can be stacked all in the same bowed orientation in compartment 25. In yet another embodiment, there are two sets of fifteen bowed slats whose lengths are half of the slat length shown in FIG. 1. One side of both sets of slats rests on longitudinal bar 22, and the other side of both sets of slats rests on support ledges 27 of side panels 14-17. The slats are distributed out in parallel over longitudinal bar 22 and support ledges 27 such that each slat bows upwards at its middle.

Longitudinal bar 22 is shown in FIG. 4 in a folded configuration as bar 22 would be packed in compartment 25. Longitudinal bar 22 includes a first connector 28, a second connector 29 and support legs 30-32. Support leg 30 is pivotally attached to an upper portion 33, and support leg 31 is pivotally attached to a lower portion 34 of longitudinal bar 22. A slot 35 is formed in longitudinal bar 22 between upper portion 33 and lower portion 34 when the portions are unfolded and extended parallel to one another. Lateral bar 23 also has support legs. Support legs 36-37 are pivotally attached at the ends of lateral bar 23. Each support leg 36-37 has an angled bracket 38-39 and a connector 40-41. Lateral bar 23 has a bracket 42 at its center that is adapted to fit over slot 35 in longitudinal bar 22. Thus, lateral bar 23 is adapted to attach to longitudinal bar 22 at the middle of lateral bar 23 when mattress support 10 is in its assembled state.

Figure 5:
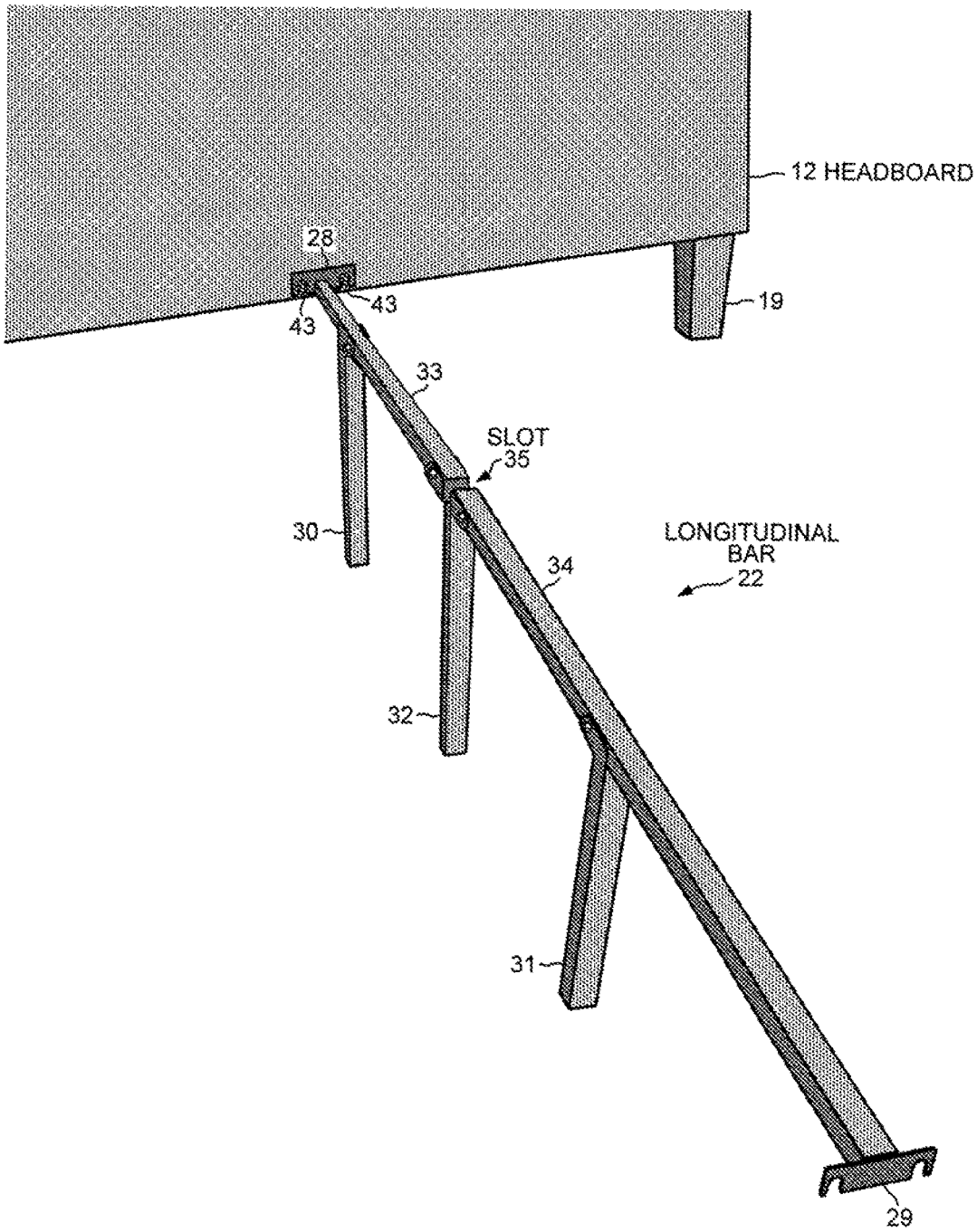
FIG. 5 shows the longitudinal bar removed from the compartment and attached to the front side of the headboard.

FIG. 5 illustrates an assembly step of mattress support 10 after the components have been removed from compartment 25, flap 23 has been zipped closed, block legs 18-19 have been attached to the bottom side of headboard 12, and headboard 12 has been stood up on legs 18-19. Longitudinal bar 22 is unfolded, and pivotally attached support legs 30-31 are extended. First connector 28 on longitudinal bar 22 is attached to a third connector 43 on the front side of headboard 12. Third connector 43 is formed by two bolts with large flat heads. Alternatively, regular bolts with washers can be used to form third connector 43. First connector 28 has two slots that slide down over the bolts of third connector 43. Thus, the two bolts are spaced apart by the same distance as are the two slots. The bolts are then tightened, for example, using an Allen wrench.

Figure 6:
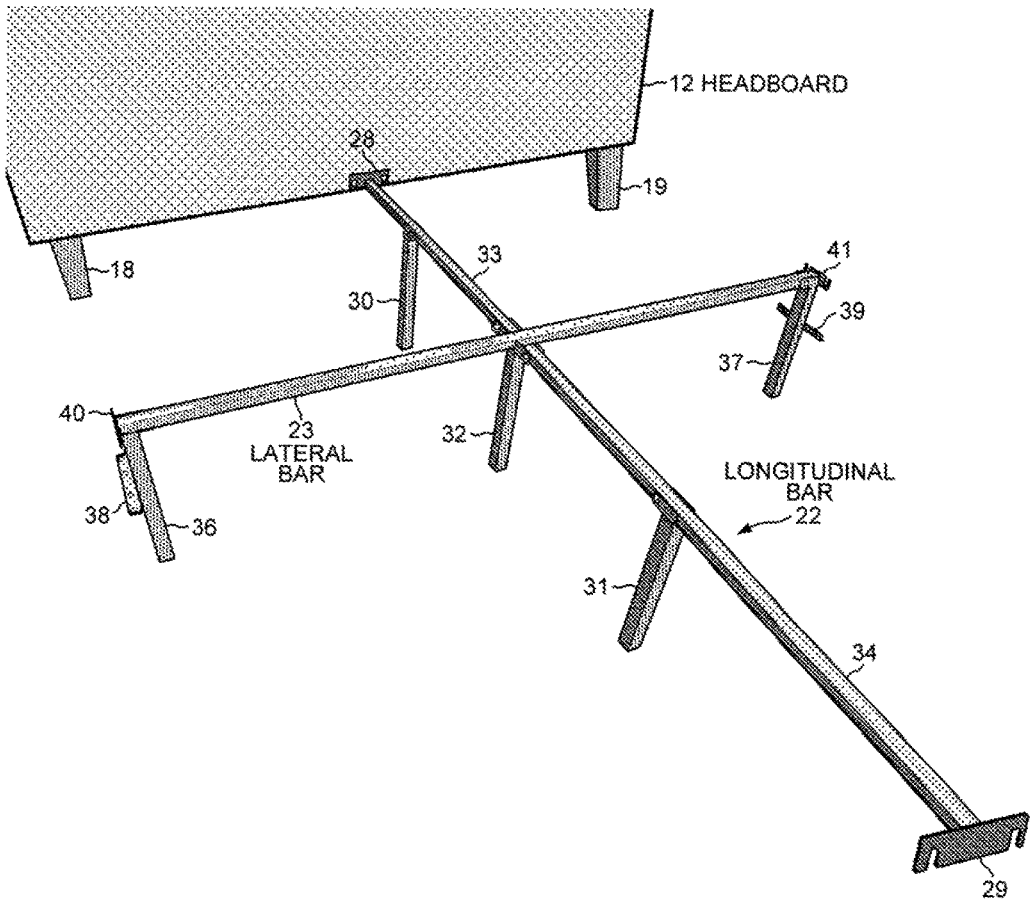
FIG. 6 shows the lateral bar attached to the longitudinal bar of FIG. 5.

FIG. 6 shows a next assembly step in which lateral bar 23 is attached to longitudinal bar 22. Pivotally attached support legs 36-37 are first extended before lateral bar 23 is placed over longitudinal bar 22. Lateral bar 23 attaches to longitudinal bar 22 when bracket 42 at the middle of lateral bar 23 slips down over slot 35 at the middle of longitudinal bar 22. Next, block legs 20-21 are screwed into the bottom side of footboard 13, and second connector 29 on longitudinal bar 22 is attached to a fourth connector 44 on footboard 13.

Figure 7:
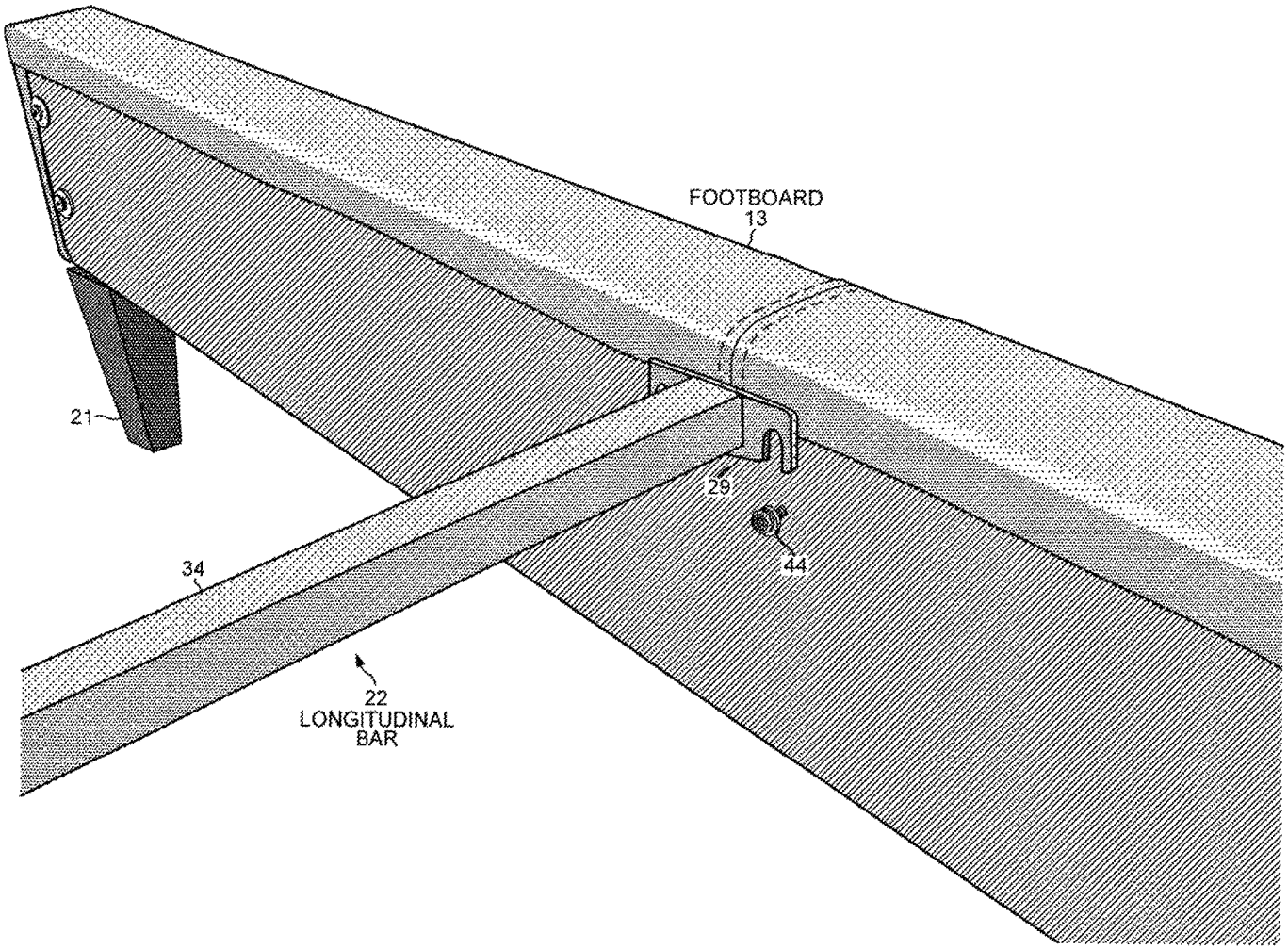
FIG. 7 shows a second connector on the longitudinal bar of FIG. 5 being attached to the footboard.

FIG. 7 shows second connector 29 on longitudinal bar 22 being attached to fourth connector 44 on footboard 13. Fourth connector 44 is formed by two bolts with washers over which slots in connector 29 slide. A slot in connector 29 has not yet slid down over bolt 44 in FIG. 7. Next, side panel 17 attaches to the bolts and washers shown to the left on footboard 13 in FIG. 7.

Figure 8:
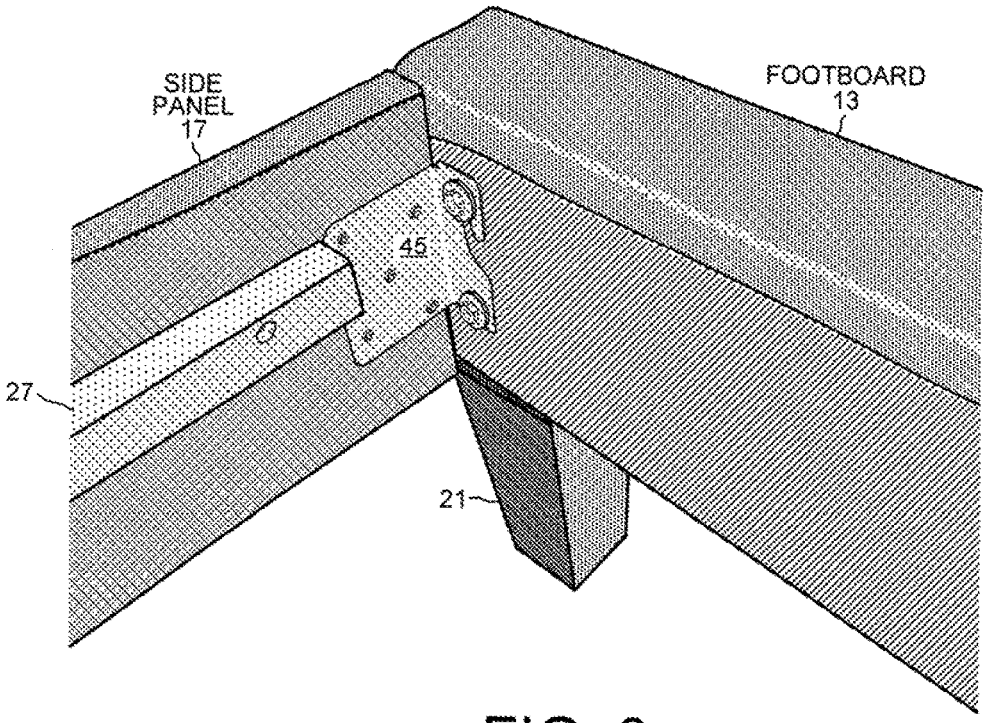
FIG. 8 shows how a side panel is attached to the footboard.

FIG. 8 shows how side panel 17 is attached to footboard 13. A connector 45 on side panel 17 has slots that slide down over Allen bolts that protrude from the inside of footboard 13. Washers separate the bolt heads from connector 45. Connector 45 is an angled piece of metal that is permanently screwed to the inside of side panel 17. The other end of side panel 17 opposite connector 45 attaches to angled bracket 39 and connector 41 on lateral bar 23. FIG. 8 also shows a support ledge 27 on the inside of side panel 17. Support ledge 27 is a piece of wood screwed to the inside of side panel 17 and on which the wooden slats 11 rest.

Figure 9:
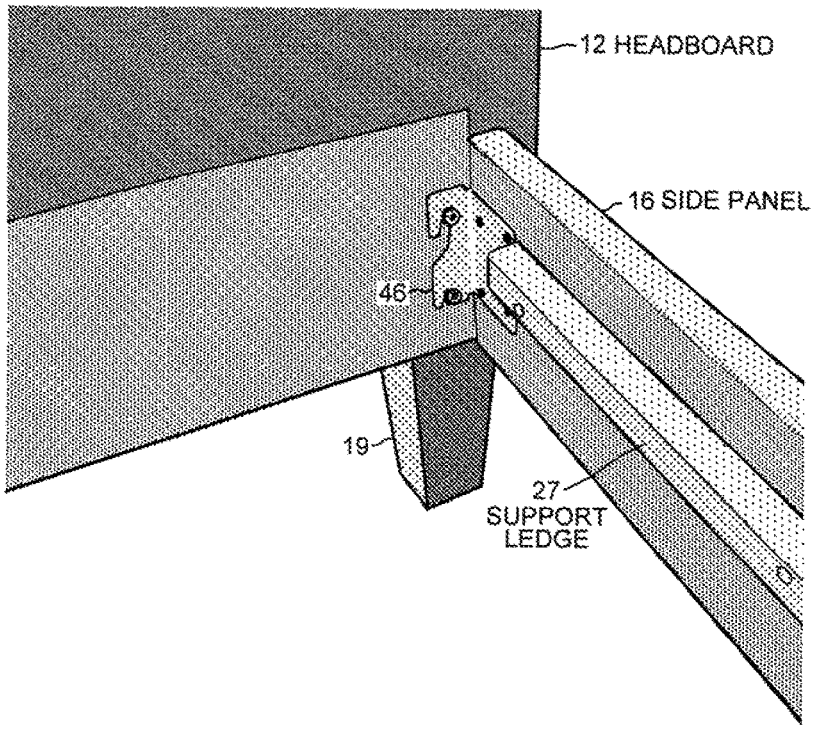
FIG. 9 shows how a side panel is attached to the headboard.

FIG. 9 shows that side panel 16 attaches to headboard 12 in a similar manner to how side panel 17 attached to footboard 13. Slots in a connector 46 slide down over bolts on the inside of headboard 12.

Figure 10:
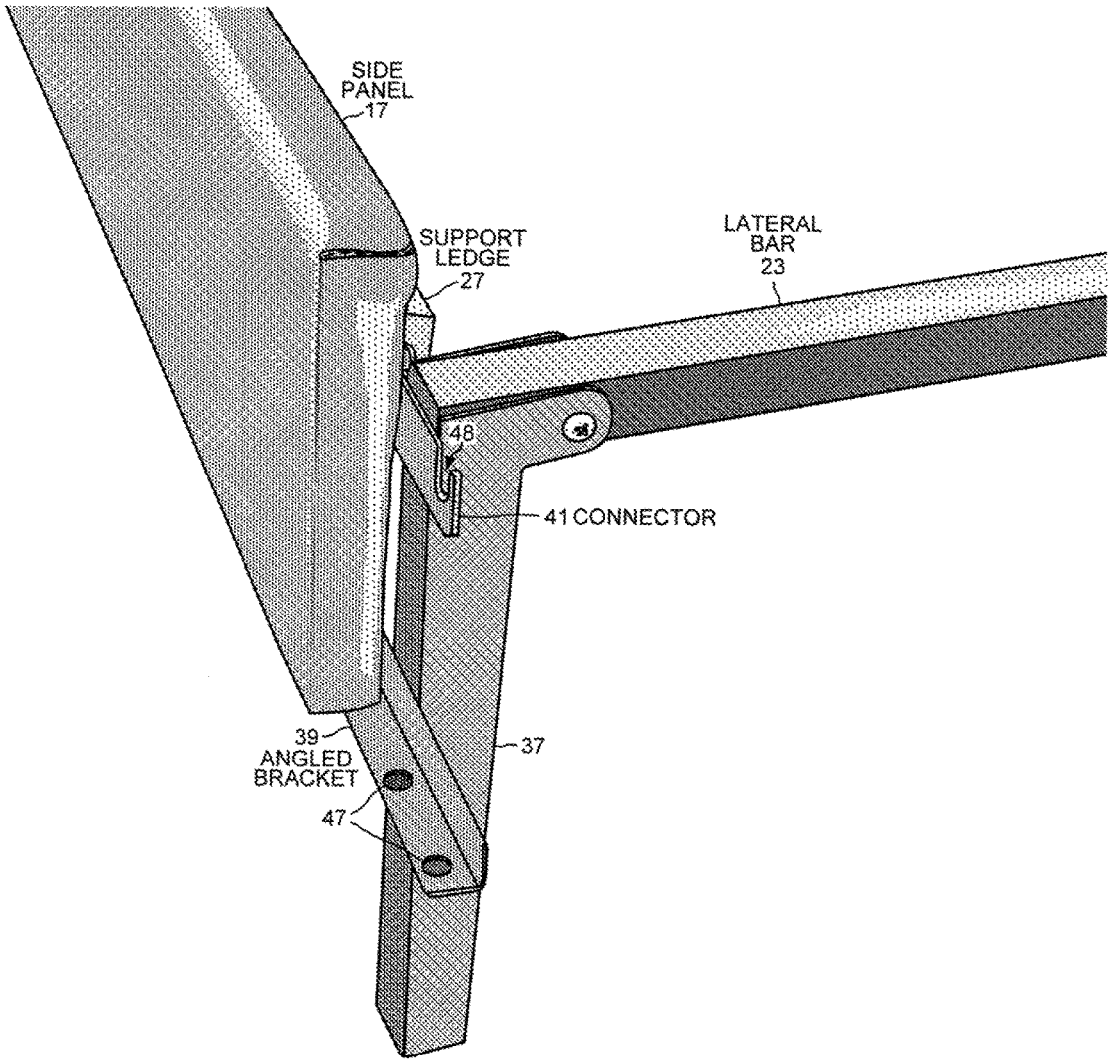
FIG. 10 shows a side panel being attached to an angled bracket and a connector on a support leg of the lateral bar.

FIG. 10 shows side panel 17 being attached to angled bracket 39 and connector 41 on support leg 37 of lateral bar 23. A bolt on the inside of side panel 17 slides down into a slot in connector 41. Another bolt passes through a hole in angled bracket 39 and screws into the bottom side of side panel 17. Optionally, two bolts can attach side panel 17 to angled bracket 39. FIG. 10 also shows two holes 47 in angled bracket 39 and an upwardly opening slot 48 in connector 41 that will be used to attach side panel 16 to support leg 37 of lateral bar 23.

Figure 11:
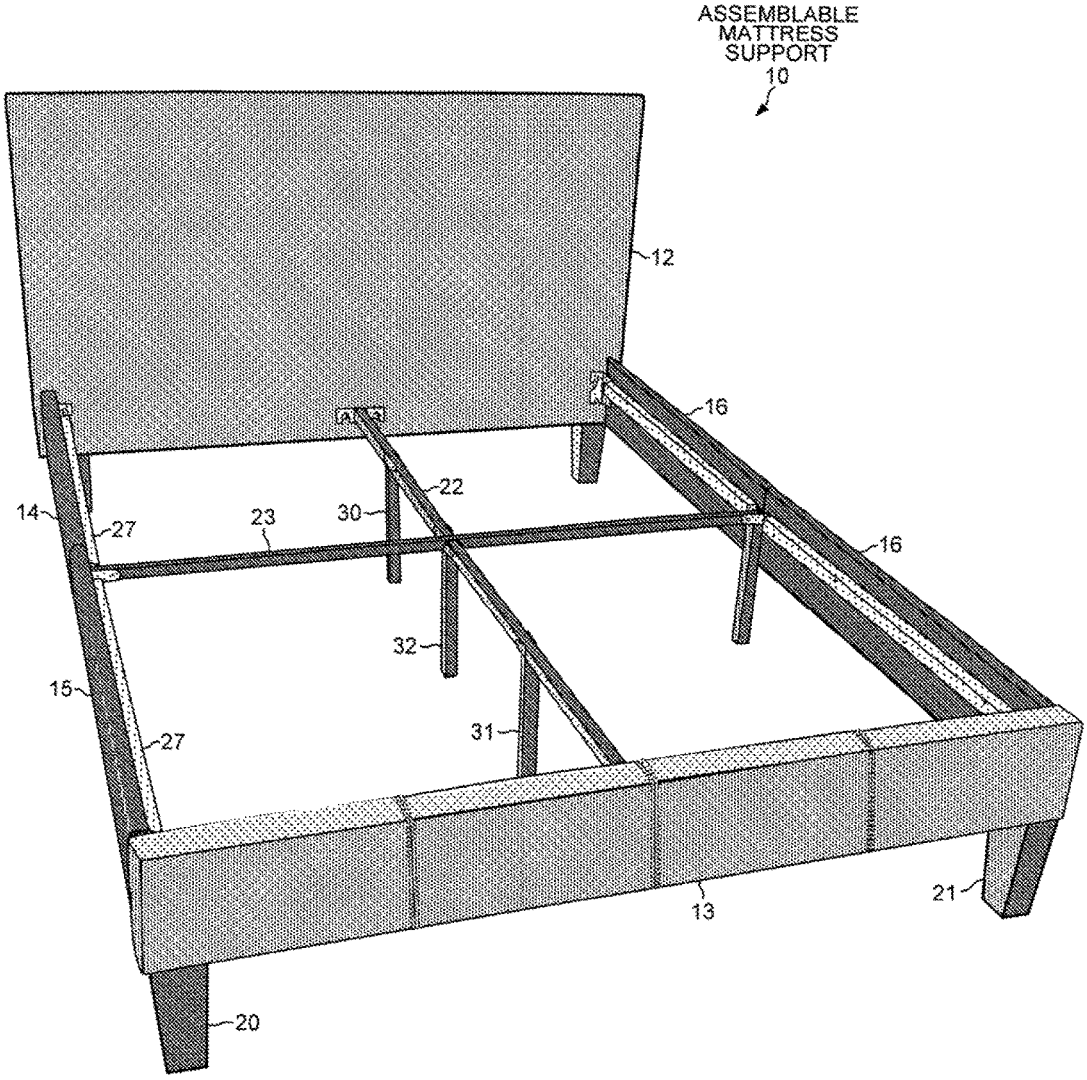
FIG. 11 is a perspective view from the front the assembled mattress support before the slats have been laid across the support ledges.

FIG. 11 shows mattress support 10 after it has been assembled but before the wooden slats 11 have been laid across the support ledges 27 and longitudinal bar 22. Although the mattress support 10 has inner dimensions that accommodate a Queen size mattress (60×80 inches), the longitudinal and lateral bars of other embodiments of mattress support are 74 and 54 inches, respectively, to accommodate a Full size mattress, 84 and 72 inches to accommodate a California King size mattress, and 80 and 76 inches to accommodate an Eastern King size mattress.

Figure 12:
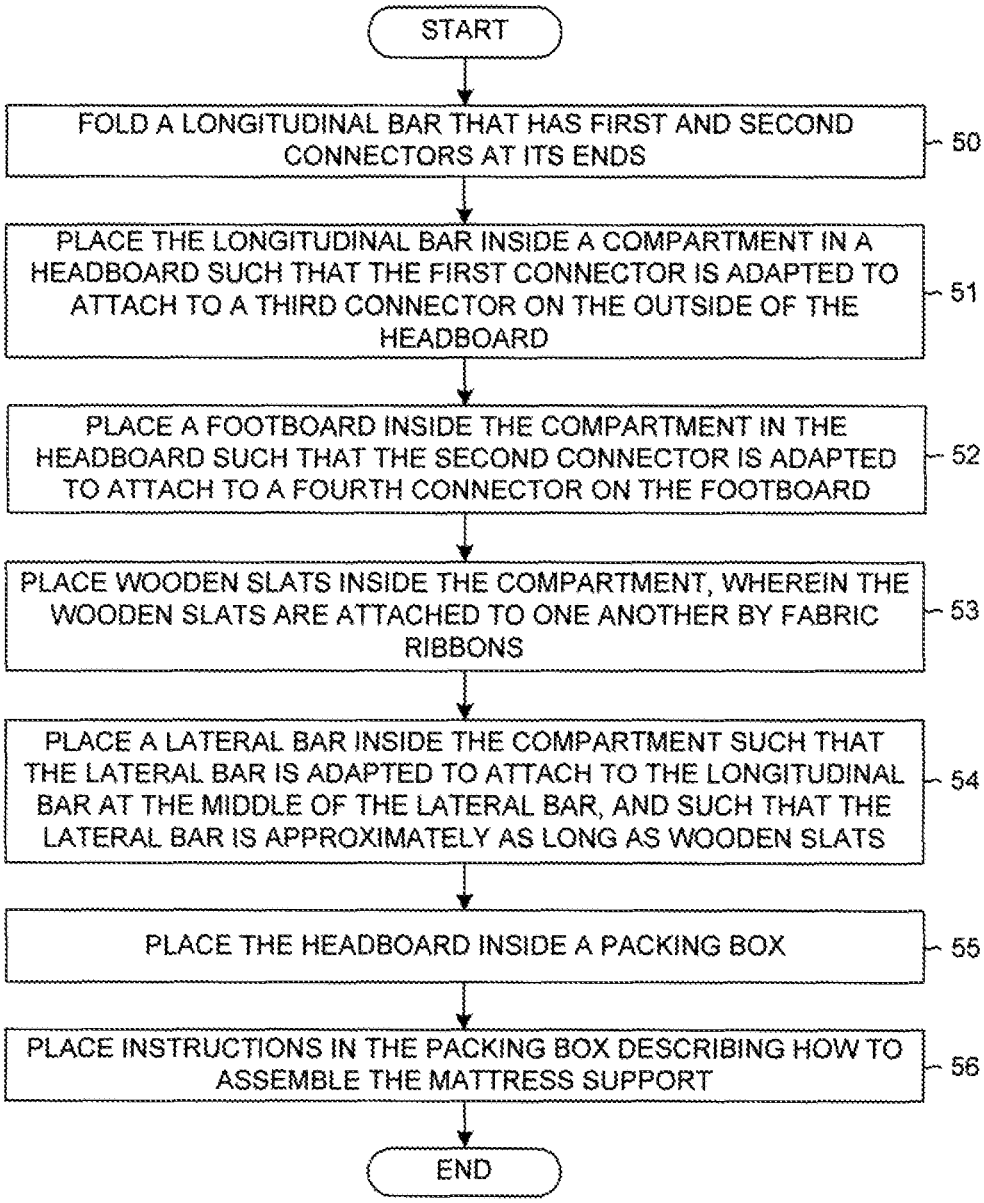
FIG. 12 is a flowchart of steps for compactly packing the mattress support of FIG. 1 for shipping.

FIG. 12 is a flowchart of steps 50-56 for packaging assemblable mattress support 10 to be shipped from the manufacturer to a warehouse of an online retailer or of a mass-market retail store. The components of mattress support 10 fit into a packing box that is more compact than a packing box that contains a conventional metal bed frame. Each side rail of a conventional metal bed frame is a single piece of angle iron. Thus, the packing box for a conventional metal bed frame is typically more than seventy-five inches long. In contrast, the packing box containing mattress support 10 has a length that is only about six inches longer than the width of the mattress that mattress support 10 is to accommodate.

In a step 50, support legs 30-31 are folded in, and longitudinal bar 22 is folded together as shown in FIG. 4. In step 51, longitudinal bar 22 is placed inside compartment 25 in headboard 12. Longitudinal bar 22 has first connector 28 that is adapted to attach to third connector 43 on the outside of headboard 12.

In step 52, footboard 13 is placed inside compartment 25. Longitudinal bar 22 has second connector 29 that is adapted to attach to fourth connector 44 on footboard 13. In step 53, wooden slats 11 are placed in compartment 25. Wooden slats are attached to one another by fabric ribbons 26.

In step 54, lateral bar 23 is placed in compartment 25. Lateral bar 23 has bracket 42 that is adapted to fit into socket 35 such that lateral bar 23 attaches at its middle to longitudinal bar 22. Lateral bar 23 is approximately as long as are wooden slats 11. The side panels 14-17 and block legs 18-21 are also placed in compartment 25. Flap 23 is then zipped closed.

In step 55, packed headboard 12 is placed in a packing box whose length is about six inches longer than the width of the mattress that is to be supported.

In step 56, instructions are placed in the packing box that instruct a purchaser of assemblable mattress support 10 on how to assemble the mattress support and to place a mattress on top of the assembled mattress support.

Although certain specific exemplary embodiments are described above in order to illustrate the invention, the invention is not limited to the specific embodiments. Accordingly, various modifications, adaptations, and combinations of various features of the described embodiments can be practiced without departing from the scope of the invention as set forth in the claims.

What is claimed is:

1. A mattress support comprising:

a longitudinal bar with a first portion and a second portion, wherein the first portion has a first connector, and the second portion has a second connector, wherein the first portion and the second portion have a combined length;

a headboard with an attachment location for a third connector, an inner compartment and an outside, wherein the attachment location for the third connector is disposed outside the inner compartment, and wherein the first connector is configured to attach directly to the third connector on the outside of the headboard; and a footboard with an attachment location for a fourth connector, wherein the second connector is configured to attach directly to the fourth connector, wherein the longitudinal bar and the footboard fit inside the inner compartment of the headboard, and wherein the inner compartment has an inner length that is shorter than the combined length of the first portion and the second portion.

2. The mattress support of claim 1, wherein the headboard has a front side and a back side, wherein the inner compartment is accessible from the back side of the headboard, and wherein the attachment location of the third connector is located on the front side of the headboard.

3. The mattress support of claim 1, further comprising:

a leg that is configured to attach to the outside of the headboard, wherein the leg fits inside the compartment of the headboard.

4. The mattress support of claim 3, wherein the leg is configured to be screwed into the outside of the headboard.

5. The mattress support of claim 1, wherein the first connector has a slot, wherein the third connector includes a bolt, and wherein the slot is configured to slide down over the bolt.

6. The mattress support of claim 1, further comprising:

a lateral bar configured to connect to the longitudinal bar, wherein the lateral bar fits inside the inner compartment.

7. The mattress support of claim 6, further comprising:

a first right side panel configured to attach directly to the headboard and directly to the lateral bar; and a second right side panel configured to attach directly to the lateral bar and directly to the footboard, wherein the first right side panel and the second right side panel fit inside the inner compartment.

8. The mattress support of claim 6, further comprising:

wooden slats that fit inside the inner compartment, wherein the wooden slats are approximately as long as the lateral bar.

9. The mattress support of claim 1, further comprising:

wooden slats attached to one another by fabric ribbons, wherein the wooden slats fit inside the inner compartment.

10. The mattress support of claim 1, wherein the first portion of the longitudinal bar is foldable over the second portion of the longitudinal bar.

11. An assemblable mattress support comprising:

a headboard with a compartment and an outside;

a footboard;

a first portion of a longitudinal bar, wherein the first portion has a first connector; and a second portion of the longitudinal bar, wherein the second portion has a second connector, wherein the first portion and second portion of the longitudinal bar and the footboard are disposed within the compartment in a compact state of the assemblable mattress support, wherein the first connector is configured to attach to the outside of the headboard when the assemblable mattress support is in an assembled state, wherein the second connector is configured to attach to the footboard in the assembled state but is not attached to the footboard when the second portion of the longitudinal bar is disposed within the compartment.

12. The assemblable mattress support of claim 11, wherein the first portion and the second portion are each pivotally attachable to a bracket.

13. The assemblable mattress support of claim 11, wherein the first portion is not attached to the second portion when the first portion and the second portion of the longitudinal bar are disposed within the compartment.

14. The assemblable mattress support of claim 11, further comprising:

a leg that is configured to attach to the outside of the headboard in the assembled state, wherein the leg is disposed inside the compartment in the compact state.

15. The assemblable mattress support of claim 11, further comprising:

a packing box that contains the headboard in the compact state of the assemblable mattress support when the headboard contains the footboard, the first portion of a longitudinal bar and the second portion of a longitudinal bar.

16. The assemblable mattress support of claim 11, further comprising:

a first pair of side panels that together form a right side panel of the assemblable mattress support when the assemblable mattress support is in the assembled state, wherein the side panels of the first pair are not connected to each other when the assemblable mattress support is in the compact state; and a second pair of side panels that together form a left side panel of the assemblable mattress support when the assemblable mattress support is in the assembled state, wherein the side panels of the second pair are not connected to each other when the assemblable mattress support is in the compact state.

17. The assemblable mattress support of claim 11, further comprising:

a first pair of side panels that together form a right side panel of the assemblable mattress support when the assemblable mattress support is in the assembled state, wherein the side panels of the first pair are not connected to each other when the assemblable mattress support is in the compact state;

a second pair of side panels that together form a left side panel of the assemblable mattress support when the assemblable mattress support is in the assembled state, wherein the side panels of the second pair are not connected to each other when the assemblable mattress support is in the compact state;

a first support leg, wherein the first support leg connects to both side panels of the first pair of side panels when the assemblable mattress support is in the assembled state; and a second support leg, wherein the second support leg connects to both side panels of the second pair of side panels when the assemblable mattress support is in the assembled state.

18. The assemblable mattress support of claim 17, wherein the first support leg comprises an angled bracket portion, wherein the angled bracket portion of the first support leg in the assembled state is bolted to each side panel of the first pair of side panels, and wherein the second support leg comprises an angled bracket portion, wherein the angled bracket portion of the second support leg in the assembled state is bolted to each side panel of the second pair of side panels.

19. The assemblable mattress support of claim 11, further comprising:

a first pair of side panels that together form a right side panel of the assemblable mattress support when the assemblable mattress support is in the assembled state, wherein side panels of the first pair are not connected to each other when the assemblable mattress support is in the compact state;

a second pair of side panels that together form a left side panel of the assemblable mattress support when the assemblable mattress support is in the assembled state, wherein the side panels of the second pair are not connected to each other when the assemblable mattress support is in the compact state;

a means for supporting the right side panel, wherein the means for supporting the right side panel is also for connecting both side panels of the first pair of side panels together when the assemblable mattress support is in the assembled state, and wherein the means for supporting the right side panel comprises a support leg portion; and a means for supporting the left side panel, wherein the means for supporting the left side panel is also for connecting both side panels of the second pair of side panels together when the assemblable mattress support is in the assembled state, and wherein the means for supporting the left side panel comprises a support leg portion.

20. The assemblable mattress support of claim 11, further comprising:

a pair of headboard legs, wherein each headboard leg of the pair of headboard legs is not attached to the headboard when the assemblable mattress support is in the compact state, and wherein the pair of headboard legs is disposed within the compartment when the assemblable mattress support is in the compact state.

21. The assemblable mattress support of claim 11, further comprising:

a plurality of mattress support slats; and a packing box that contains the headboard when the assemblable mattress support is in the compact state, wherein the assemblable mattress support is configured to support a mattress on the mattress support slats when the assemblable mattress support is in the assembled state, wherein the mattress has a width, and wherein the packing box has a length that is only about six inches longer than the width of the mattress.

22. The assemblable mattress support of claim 11, further comprising:

a pair of headboard legs, wherein each headboard leg of the pair of headboard legs is not attached to the headboard when the assemblable mattress support is in the compact state, wherein each headboard leg is screwed into a bottom side of the headboard when the assemblable mattress support is in the assembled state.

23. The assemblable mattress support of claim 11, wherein the headboard has an openable fabric flap that covers the compartment when the assemblable mattress support is in the compact state.

24. An assemblable mattress support comprising:

a headboard having a compartment;

a footboard;

a longitudinal bar comprising a first portion and a second portion, wherein the first portion and second portion of the longitudinal bar and the footboard are disposed within the compartment in a compact state of the assemblable mattress support, and wherein the longitudinal bar is not attached to either the headboard or the footboard when the assemblable mattress support is in the compact state;

a first pair of side panels that together form a right side panel of the assemblable mattress support when the assemblable mattress support is in the assembled state, wherein side panels of the first pair are not connected to each other when the assemblable mattress support is in the compact state;

a second pair of side panels that together form a left side panel of the assemblable mattress support when the assemblable mattress support is in the assembled state, wherein the side panels of the second pair are not connected to each other when the assemblable mattress support is in the compact state;

a pair of headboard legs, wherein the headboard legs are not attached to the headboard when the assemblable mattress support is in the compact state;

a plurality of mattress support slats; and a packing box that contains the headboard in the compact state of the assemblable mattress support, wherein in the compact state the footboard, the first and second portions of the longitudinal bar, the first pair of side panels, the second pair of side panels, the pair of headboard legs and the plurality of mattress support slats are all disposed in the compartment of the headboard.

25. The assemblable mattress support of claim 24, wherein the assemblable mattress support is configured to support a mattress on the mattress support slats when the assemblable mattress support is in the assembled state, wherein the mattress has a width, and wherein the packing box has a length that is only about six inches longer than the width of the mattress.

* * * * *